US011118299B2

(12) United States Patent
Holzen et al.

(10) Patent No.: US 11,118,299 B2
(45) Date of Patent: Sep. 14, 2021

(54) WASHING MACHINE APPLIANCE GASKET

(71) Applicant: Haier US Appliance Solutions, Inc., Wilmington, DE (US)

(72) Inventors: Thomas Holzen, Louisville, KY (US); Aaron Daniel Abbott, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 156 days.

(21) Appl. No.: 16/272,008

(22) Filed: Feb. 11, 2019

(65) Prior Publication Data

US 2020/0256001 A1 Aug. 13, 2020

(51) Int. Cl.
*D06F 37/26* (2006.01)
*D06F 23/02* (2006.01)

(52) U.S. Cl.
CPC ..... *D06F 37/266* (2013.01); *D06F 23/02* (2013.01)

(58) Field of Classification Search
CPC ..... D06F 37/266; D06F 23/02
USPC ..... 68/212
See application file for complete search history.

(56) References Cited

U.S. PATENT DOCUMENTS

| | | | | |
|---|---|---|---|---|
| 6,256,823 | B1 | 7/2001 | Kronbetter et al. | |
| 10,053,808 | B2 | 8/2018 | Erickson et al. | |
| 2006/0174663 | A1 | 8/2006 | Cimetta et al. | |
| 2011/0088172 | A1* | 4/2011 | Im | D06F 37/267 8/137 |

FOREIGN PATENT DOCUMENTS

| | | | |
|---|---|---|---|
| FR | 2753209 | A1 | 3/1998 |
| KR | 100697082 | B1 | 3/2007 |
| KR | 1221460 | B1 | 1/2013 |

OTHER PUBLICATIONS

KR100697082B1—Machine translation (Year: 2007).*
KR101221460B1—Machine translation (Year: 2013).*

* cited by examiner

*Primary Examiner* — Tinsae B Ayalew
(74) *Attorney, Agent, or Firm* — Dority & Manning, P.A.

(57) ABSTRACT

A washing machine has a cabinet, a wash tub positioned within the cabinet, and a wash basket rotatably mounted within the wash tub. The wash basket is accessible through an opening in the cabinet. The washing machine appliance also includes a door rotatably mounted to the cabinet such that the door is rotatable between an open position and a closed position and a gasket which sealingly engages the door when the door is in the closed position. The gasket includes an S-fold. The S-fold defines a trough and a gap between a front portion of the gasket and a back ring of the gasket. A width of the gap may be at least fifty percent of a width of the trough. A channel may be defined in the trough.

17 Claims, 14 Drawing Sheets

WASHING MACHINE APPLIANCE GASKET

FIELD OF THE INVENTION

The present subject matter relates generally to washing machine appliances, such as horizontal axis washing machine appliances, and to gaskets for such washing machine appliances.

BACKGROUND OF THE INVENTION

Washing machine appliances generally include a cabinet which receives a wash tub for containing water or wash fluid (e.g., water and detergent, bleach, or other wash additives). The wash tub may be suspended within the cabinet by a suspension system to allow some movement relative to the cabinet during operation. A basket is rotatably mounted within the wash tub and defines a wash chamber for receipt of articles for washing. During normal operation of such washing machine appliances, the wash fluid is directed into the wash tub and onto articles within the wash chamber of the basket. A drive assembly is coupled to the wash tub and configured to rotate the wash basket within the wash tub to agitate articles within the wash chamber, to wring wash fluid from articles within the wash chamber, etc.

The basket may be accessible through an opening in the cabinet. A door may be hingedly mounted to the cabinet at the opening for rotating between an open position and a closed position. The door generally sealingly encloses the opening of the cabinet when the door is in the closed position. Such sealing enclosure may be aided by a gasket positioned at the opening which engages the door when the door is in the closed position. The gasket must accommodate relative movement, e.g., of the tub and/or basket relative to the door and/or cabinet. Generally, such gaskets may be folded over on themselves to allow for such relative movement. However, this folding typically creates an at least partly enclosed gutter portion within the gasket, which may become clogged or may collect debris or stagnant water.

Accordingly, improved gaskets for washing machine appliances are desired. In particular, gaskets which provide increased visibility of and/or access to internal folds thereof would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance has a cabinet, a wash tub positioned within the cabinet, and a wash basket rotatably mounted within the wash tub. The wash basket is accessible through an opening in the cabinet. The washing machine appliance also includes a door rotatably mounted to the cabinet such that the door is rotatable between an open position permitting access to the wash basket through the opening and a closed position. A gasket extends around the opening along a circumferential direction and extends between the cabinet and the wash tub along an axial direction. The gasket sealingly engages the door when the door is in the closed position. The gasket includes a front ring engaging the opening in the cabinet, a back ring engaging the tub, and a web extending from the front ring to the back ring. The web includes an S-fold. A front portion of the web extends from the front ring to a first bend of the S-fold. The web also includes a trough extending from a second bend of the S-fold to the back ring. A distance from the first bend of the S-fold to the back ring of the gasket along the axial direction is at least fifty percent of a distance from the second bend to the back ring along the axial direction.

In another exemplary aspect of the present disclosure, a washing machine appliance is provided. The washing machine appliance has a cabinet, a wash tub positioned within the cabinet, and a wash basket rotatably mounted within the wash tub. The wash basket is accessible through an opening in the cabinet. The washing machine appliance also includes a door rotatably mounted to the cabinet such that the door is rotatable between an open position permitting access to the wash basket through the opening and a closed position. A gasket extends around the opening along a circumferential direction and extends between the cabinet and the wash tub along an axial direction. The gasket sealingly engages the door when the door is in the closed position. The gasket includes a front ring engaging the opening in the cabinet, a back ring engaging the tub, and a web extending from the front ring to the back ring. The web includes an S-fold. A front portion of the web extends from the front ring to a first bend of the S-fold. The web also includes a trough extending from a second bend of the S-fold to the back ring. A channel is defined in the trough. The channel extends along the circumferential direction between a top portion of the gasket and a bottom portion of the gasket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
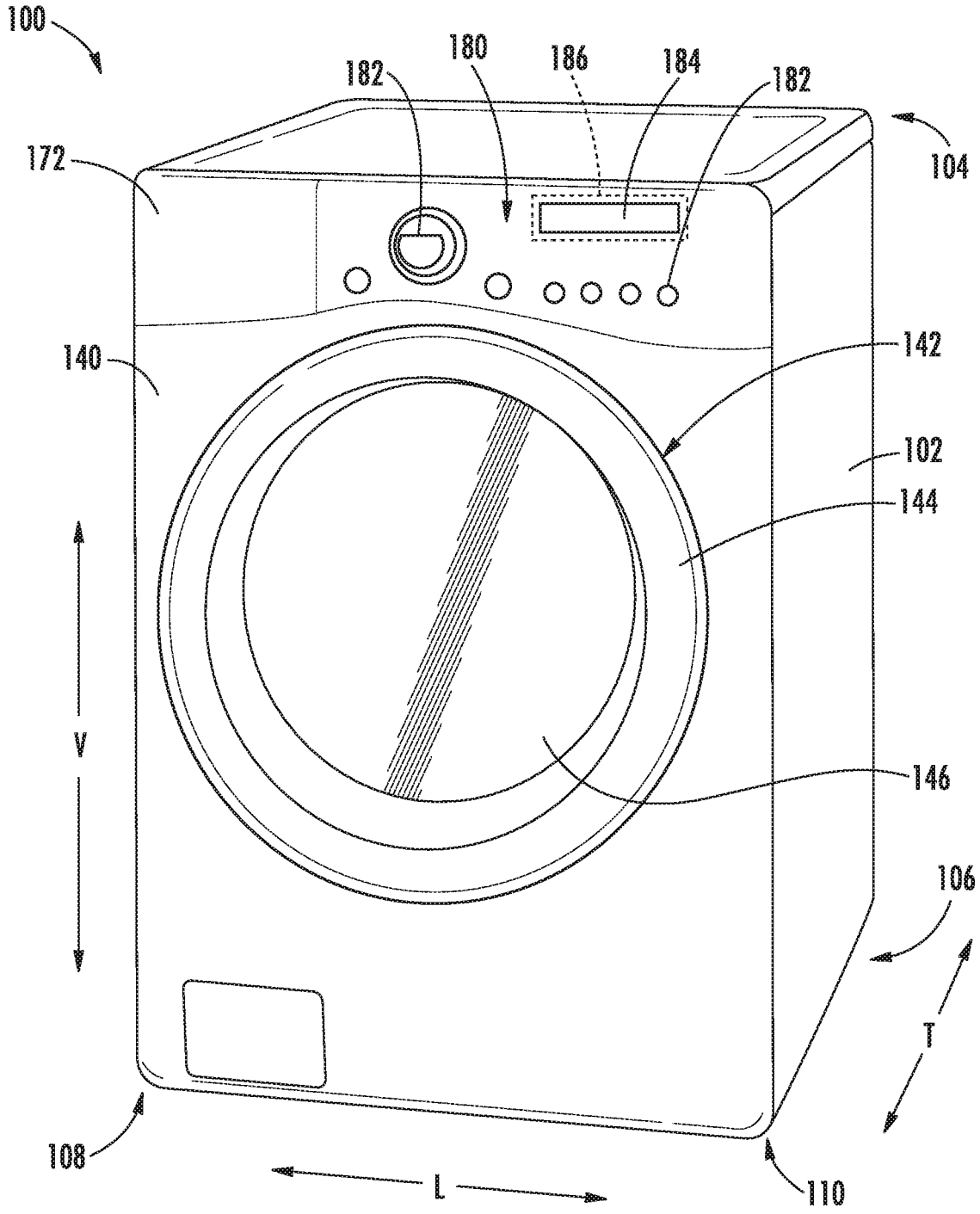
FIG. 1 provides a perspective view of a washing machine appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Terms such as "inner" and "outer" refer to relative directions with respect to the interior and exterior of the washing machine appliance, and in particular the wash basket therein. For example, "inner" or "inward" refers to the direction towards the interior of the washing machine appliance. Terms such as "left," "right," "front," "back," "top," or "bottom" are used with reference to the perspective of a user accessing the washing machine appliance. For example, a user stands in front of the washing machine appliance to open the door and reaches into the wash basket to access items therein. Furthermore, it should be appreciated that as used herein, terms of approximation, such as "approximately," "substantially," or "about," refer to being within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
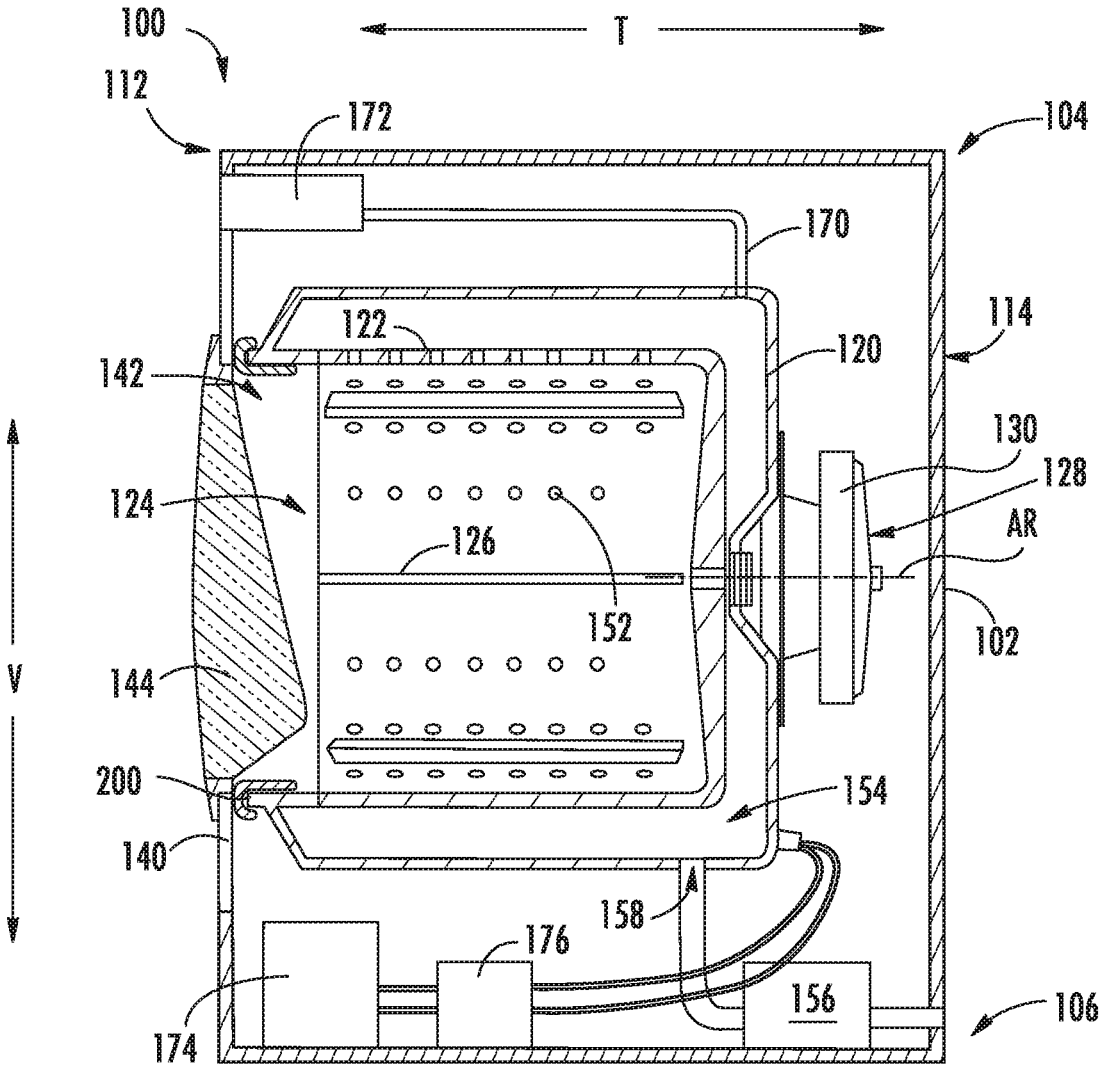
FIG. 2 provides a cross-sectional side view of the exemplary washing machine appliance.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash tub 120 is positioned within cabinet 102 and is generally configured for retaining wash fluids during an operating cycle. As used herein, "wash fluid" may refer to water, detergent, fabric softener, bleach, or any other suitable wash additive or combination thereof. A wash basket 122 is received within wash tub 120 and defines a wash chamber 124 that is configured for receipt of articles for washing. More specifically, wash basket 122 is rotatably mounted within wash tub 120 such that it is rotatable about an axis of rotation AR. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 122 may define one or more agitator features that extend into wash chamber 124 to assist in agitation and cleaning articles disposed within wash chamber 124 during operation of washing machine appliance 100. For example, as illustrated in FIG. 2, a plurality of ribs 126 extends from basket 122 into wash chamber 124. In this manner, for example, ribs 126 may lift articles disposed in wash basket 122 during rotation of wash basket 122.

Washing machine appliance 100 includes a drive assembly 128 which is coupled to wash tub 120 and is generally configured for rotating wash basket 122 during operation, e.g., such as during an agitation or spin cycle. More specifically, as best illustrated in FIG. 2, drive assembly 128 may include a motor assembly 130 that is in mechanical communication with wash basket 122 to selectively rotate wash basket 122 (e.g., during an agitation or a rinse cycle of washing machine appliance 100). According to the illustrated embodiment, motor assembly 130 is a pancake motor. However, it should be appreciated that any suitable type, size, or configuration of motors may be used to rotate wash basket 122 according to alternative embodiments. In addition, drive assembly 128 may include any other suitable number, types, and configurations of support bearings or drive mechanisms.

Referring generally to FIGS. 1 and 2, cabinet 102 also includes a front panel 140 that defines an opening 142 that permits user access to wash basket 122. More specifically, washing machine appliance 100 includes a door 144 that is positioned over opening 142 and is rotatably mounted to front panel 140 (e.g., about a door axis that is substantially parallel to the vertical direction V). In this manner, door 144 permits selective access to opening 142 by being movable between an open position (not shown) facilitating access to a wash tub 120 and a closed position (FIG. 1) prohibiting access to wash tub 120. A gasket 200 may be provided in the opening 142 and the gasket 200 may sealingly engage the door 144 when the door 144 is in the closed position. For example, the gasket 200 may extend between the tub 120 and the front panel 140, e.g., generally along the transverse direction T and may extend about or around the opening 142 such that the gasket 200 is covered by the door 144 when the door 144 is in the closed position, and the gasket 200 may promote sealing between the door 144 and the cabinet 102, e.g., the front panel 140 of the cabinet 102.

In some embodiments, a window 146 in door 144 permits viewing of wash basket 122 when door 144 is in the closed position (e.g., during operation of washing machine appliance 100). Door 144 also includes a handle (not shown) that, for example, a user may pull when opening and closing door 144. Further, although door 144 is illustrated as mounted to front panel 140, it should be appreciated that door 144 may be mounted to another side of cabinet 102 or any other suitable support according to alternative embodiments.

Referring again to FIG. 2, wash basket 122 also defines a plurality of perforations 152 in order to facilitate fluid communication between an interior of basket 122 and wash tub 120. A sump 154 is defined by wash tub 120 at a bottom of wash tub 120 along the vertical direction V. Thus, sump 154 is configured for receipt of, and generally collects, wash fluid during operation of washing machine appliance 100. For example, during operation of washing machine appliance 100, wash fluid may be urged (e.g., by gravity) from basket 122 to sump 154 through the plurality of perforations 152. A pump assembly 156 is located beneath wash tub 120 for gravity assisted flow when draining wash tub 120 (e.g., via a drain 158). Pump assembly 156 is also configured for recirculating wash fluid within wash tub 120.

Referring still to FIGS. 1 and 2, in some embodiments, washing machine appliance 100 may include an additive dispenser or spout 170. For example, spout 170 may be in fluid communication with a water supply (not shown) in order to direct fluid (e.g., clean water) into wash tub 120. Spout 170 may also be in fluid communication with the sump 154. For example, pump assembly 156 may direct wash fluid disposed in sump 154 to spout 170 in order to circulate wash fluid in wash tub 120.

As illustrated, a detergent drawer 172 may be slidably mounted within front panel 140. Detergent drawer 172 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 172 may also be fluidly coupled to spout 170 to facilitate the complete and accurate dispensing of wash additive.

In some embodiments, an optional bulk reservoir 174 may be disposed within cabinet 102. Bulk reservoir 174 may be configured for receipt of fluid additive for use during operation of washing machine appliance 100. Moreover, bulk reservoir 174 may be sized such that a volume of fluid additive sufficient for a plurality or multitude of wash cycles of washing machine appliance 100 (e.g., five, ten, twenty, fifty, or any other suitable number of wash cycles) may fill bulk reservoir 174. Thus, for example, a user can fill bulk reservoir 174 with fluid additive and operate washing machine appliance 100 for a plurality of wash cycles without refilling bulk reservoir 174 with fluid additive. A reservoir pump 176 may be configured for selective delivery of the fluid additive from bulk reservoir 174 to wash tub 120.

A control panel 180 including a plurality of input selectors 182 may be coupled to front panel 140. Control panel 180 and input selectors 182 collectively form a user interface input for operator selection of machine cycles and features. A display 184 of control panel 180 indicates selected features, operation mode, a countdown timer, and/or other items of interest to appliance users regarding operation.

Operation of washing machine appliance 100 is controlled by a processing device or a controller 186 that is operatively coupled to control panel 180 for user manipulation to select washing machine cycles and features. In response to user manipulation of control panel 180, controller 186 operates the various components of washing machine appliance 100 to execute selected machine cycles and features. Controller 186 may include a memory and microprocessor, such as a general or special purpose microprocessor operable to execute programming instructions or micro-control code associated with methods described herein. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 186 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 180 may be in communication with controller 186 via one or more signal lines or shared communication busses to provide signals to and/or receive signals from the controller 186.

In exemplary embodiments, during operation of washing machine appliance 100, laundry items are loaded into wash basket 122 through opening 142, and a wash operation is initiated through operator manipulation of input selectors 182. For example, a wash cycle may be initiated such that wash tub 120 is filled with water, detergent, or other fluid additives (e.g., via detergent drawer 172 or bulk reservoir 174). One or more valves (not shown) can be controlled by washing machine appliance 100 to provide for filling wash basket 122 to the appropriate level for the amount of articles being washed or rinsed. By way of example, once wash basket 122 is properly filled with fluid, the contents of wash basket 122 can be agitated (e.g., with ribs 126) for an agitation phase of laundry items in wash basket 122. During the agitation phase, the basket 122 may be motivated about the axis of rotation AR at a set speed (e.g., first speed or tumble speed). As the basket 122 is rotated, articles within the basket 122 may be lifted and permitted to drop therein.

After the agitation phase of the washing operation is completed, wash tub 120 can be drained, e.g., by drain pump assembly 156. Laundry articles can then be rinsed (e.g., through a rinse cycle) by again adding fluid to wash tub 120, depending on the particulars of the cleaning cycle selected by a user. Ribs 126 may again provide agitation within wash basket 122. One or more spin cycles may also be used. In particular, a spin cycle may be applied after the wash cycle or after the rinse cycle in order to wring wash fluid from the articles being washed. During a spin cycle, basket 122 is rotated at relatively high speeds. For instance, basket 122 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 122 increases its rotational velocity such that the plaster speed maintains the articles at a generally fixed position relative to basket 122. After articles disposed in wash basket 122 are cleaned (or the washing operation otherwise ends), a user can remove the articles from wash basket 122 (e.g., by opening door 144 and reaching into wash basket 122 through opening 142).

During such operations, a gasket 200 may help to contain wash fluid within the cabinet 102, particularly within the tub 120. As generally shown in FIG. 2, the gasket 200 may be positioned between the door 144 and the tub 120, e.g., when the door 144 is in the closed position as in FIG. 2. Thus, the gasket 200 may sealingly engage the door 144 when the door 144 is in the closed position. In general, the gasket 200 sealingly engages the cabinet 102, in particular the opening 142 thereof, the tub 120, and the door 144. For example, the gasket 200 may extend around the opening 142 along a circumferential direction C (FIG. 3) and may extend between the cabinet 102 and the wash tub 120 along an axial direction A (FIG. 3).

Figure 3:
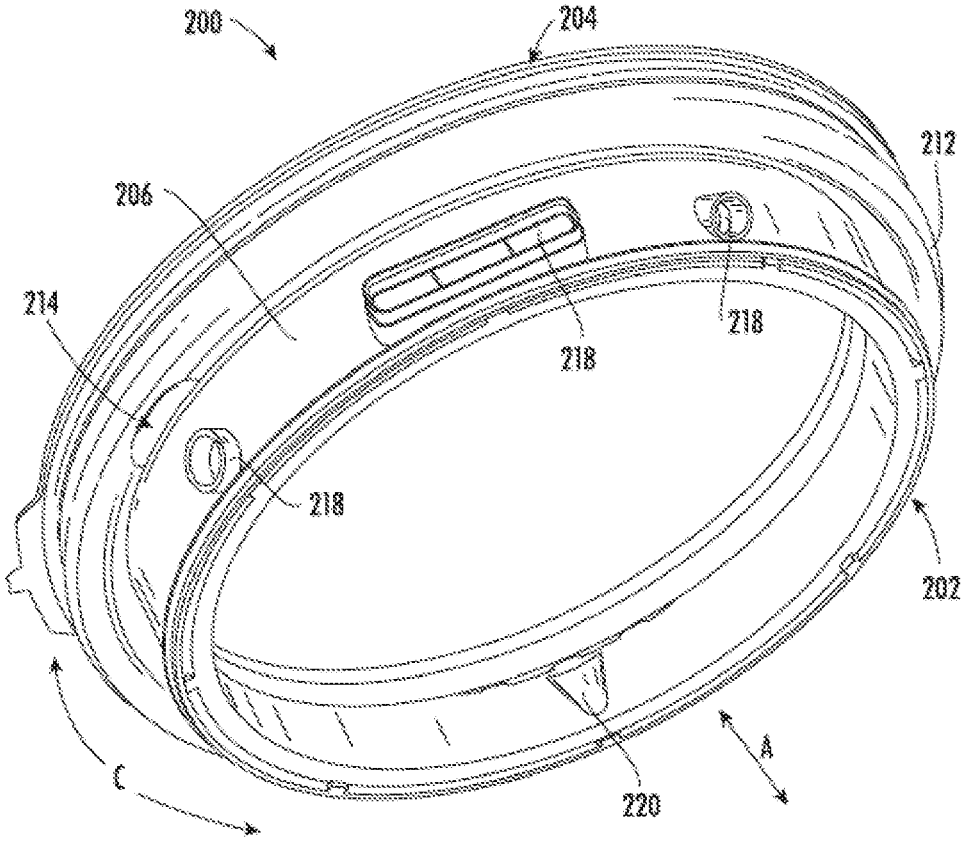
FIG. 3 provides a perspective view of an exemplary gasket for a washing machine appliance according to one or more embodiments of the present disclosure.

FIG. 3 provides a perspective view of an exemplary gasket 200 according to one or more embodiments of the present disclosure. As mentioned, the gasket 200 may define a circumferential direction C extending around the gasket 200, an axial direction A extending along the gasket 200, and a radial direction R perpendicular to the circumferential direction C and the axial direction A. The gasket 200 is illustrated in isolation, e.g., without the cabinet 102 or wash tub 120, to more clearly depict features of the gasket 200. As may be seen in FIG. 3, the gasket 200 may include a front ring 202 configured to engage the opening 142 in the cabinet 102 and a back ring 204 configured to engage the tub 120. Additionally, the gasket 200 may include a web 206 extending from the front ring 202 to the back ring 204, e.g., along the axial direction A. As will be described in more detail below, the gasket 200 may include a channel 212 defined in the web 206.

Figure 4:
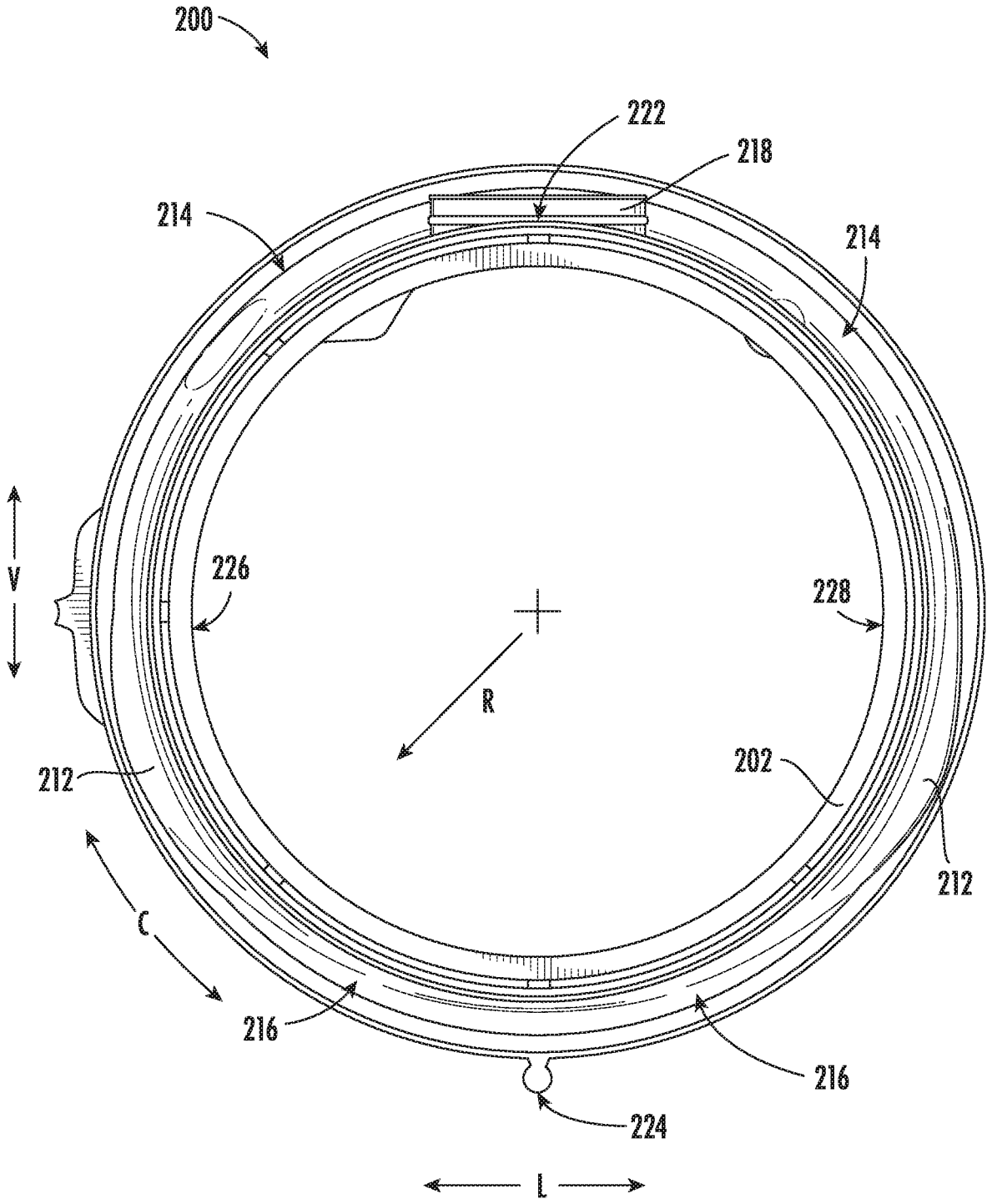
FIG. 4 provides a front view of the gasket of FIG. 3.
Figure 5:
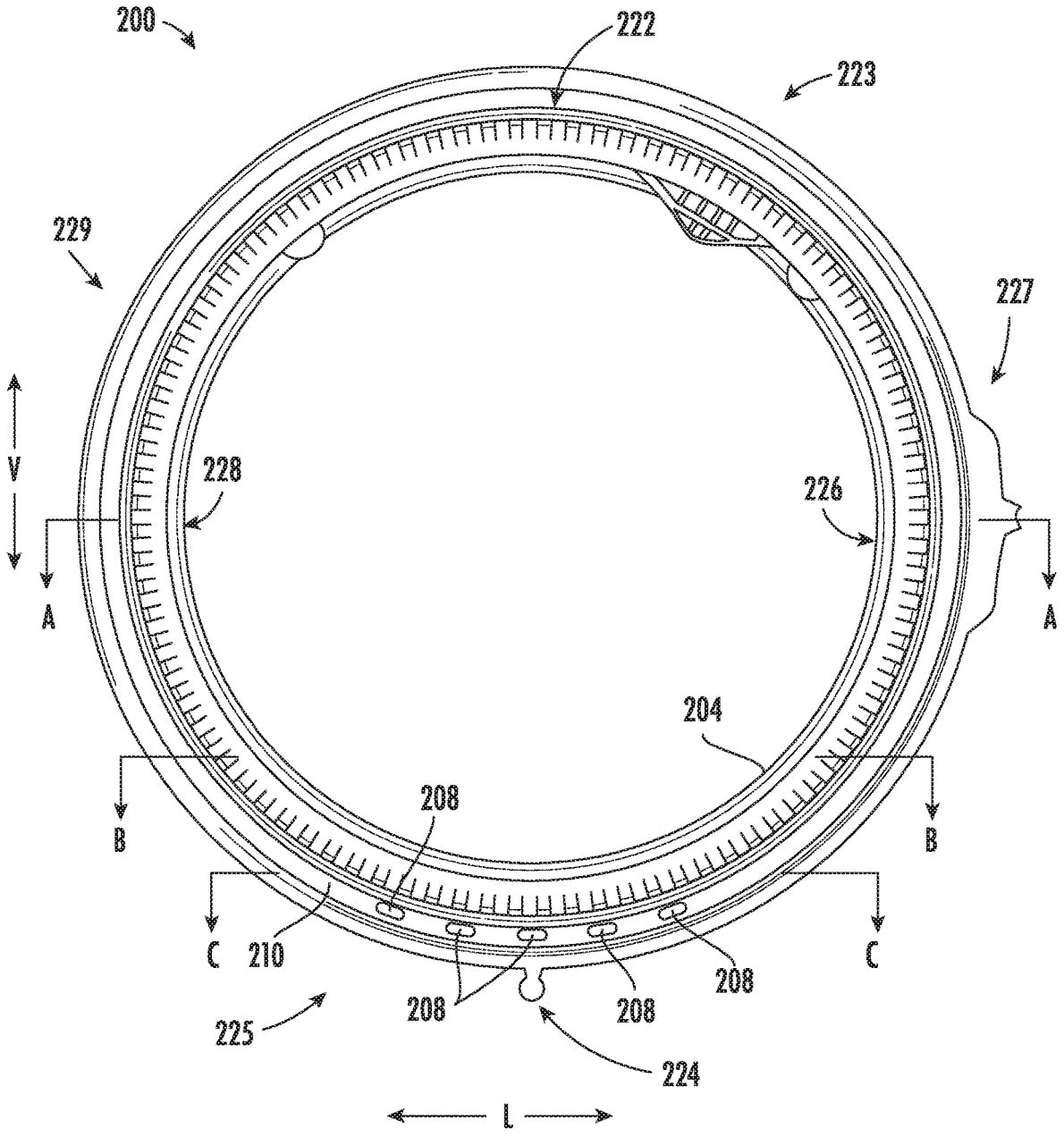
FIG. 5 provides a back view of the gasket of FIG. 3

FIG. 4 provides a front view of the gasket 200 and FIG. 5 provides a back view of the gasket 200. The front ring 202 (best seen in FIG. 4) may also be considered an outer ring in that it is more proximate to the exterior of the cabinet 102 while the back ring 204 (best seen in FIG. 5) may also be considered an inner ring in that it is more proximate the interior of the cabinet 102, each relative to the other. For example, the back ring 204 is closer to the interior of the cabinet 102 than the front ring 202 and is oriented towards the interior of the cabinet 102. As may be seen for example in FIG. 5, the back ring 204 may include a plurality of drain holes 208, e.g., in an inner face 210 of the back ring 204. Where the inner face 210 is oriented into the cabinet 102, in particular, into the tub 120, wash fluid which accumulates within the gasket 200 may be drained out of the gasket 200 into the tub 120 and into the sump 154 described above via the drain holes 208.

As shown in FIGS. 4 and 5, the gasket may include a top end 222 and a bottom end 224 opposite the top end 222, e.g., along the vertical direction V. The gasket 200 may also include a left end 226 and a right end 228 which are diametrically opposed along the lateral direction L. In particular, the top end 222 may be at a 12 o'clock or zero degrees (0°) position, the right end may be at a 3 o'clock or ninety degrees (90°) position, the bottom end 224 may be at a 6 o'clock or one hundred and eighty degrees (180°) position, and the left end 226 may be at a 9 o'clock or two hundred and seventy degrees (270°) position. As noted in FIG. 5, the gasket may also include a top portion 223 centered around the top end 222, a bottom portion 225 centered around the bottom end 224, a left portion 227 centered around the left end 226, and a right portion 229 centered around the right end 228. The top portion, bottom portion, left portion, and right portion may be quadrants of the gasket 200, e.g., each portion may extend along the circumferential direction C along an arc of about ninety degrees (90°).

In various embodiments, the gasket 200 may include a channel 212 extending along the circumferential direction C between the top end 222 and the bottom end 224, e.g., from a channel start 214 to a channel end 216. In some embodiments, described in further detail below, the channel 212 may extend continuously across the bottom portion 225 and bottom end 224. In other embodiments, such as the example embodiment illustrated in FIGS. 4 and 5, the channel 212 may extend along an arc of about ninety degrees (90°) from the channel start 214 to the channel end 216. For example, as best seen in FIG. 4, the arc of the channel 212 may be centered on the right end 228 of the gasket 200, such that the channel 212 extends about forty five degrees (45°) on either side, e.g., above and below, the right end 228 of the gasket 200. Thus, the channel 212 may be generally coextensive with the right portion 229. In such embodiments, a first channel 212 and a second channel 212 may be provided. The second channel 212 may be symmetrical (e.g., mirrored) with and opposite of the first channel 212, and each channel 212 may be centered on one of the left end 226 and the right end 228 and generally coextensive with the left portion 227 and right portion 229, respectively. Note that, as shown in FIG. 4, the channel start 214 of each channel 212 is the end of the channel 212 which is closest to the top end 222 of the gasket in that wash fluid within the gasket 200 will generally flow downward along the vertical direction V, e.g., within the channel 212 from the channel start 214 to the channel end 216.

Figure 6:
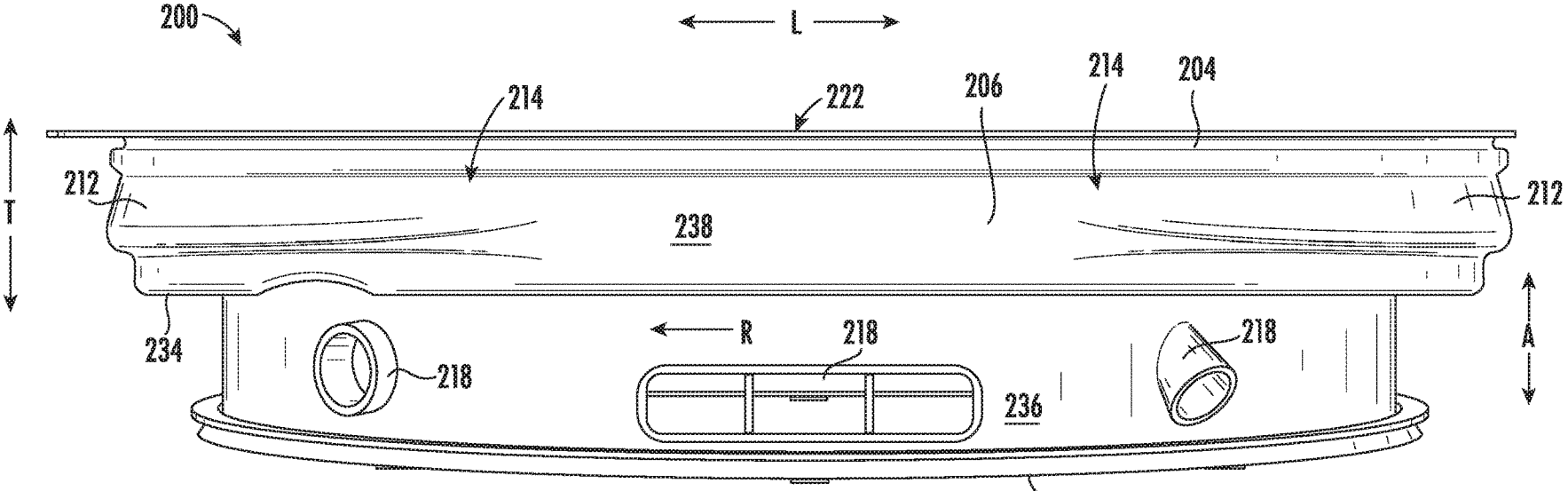
FIG. 6 provides a top view of the gasket of FIG. 3.
Figure 7:
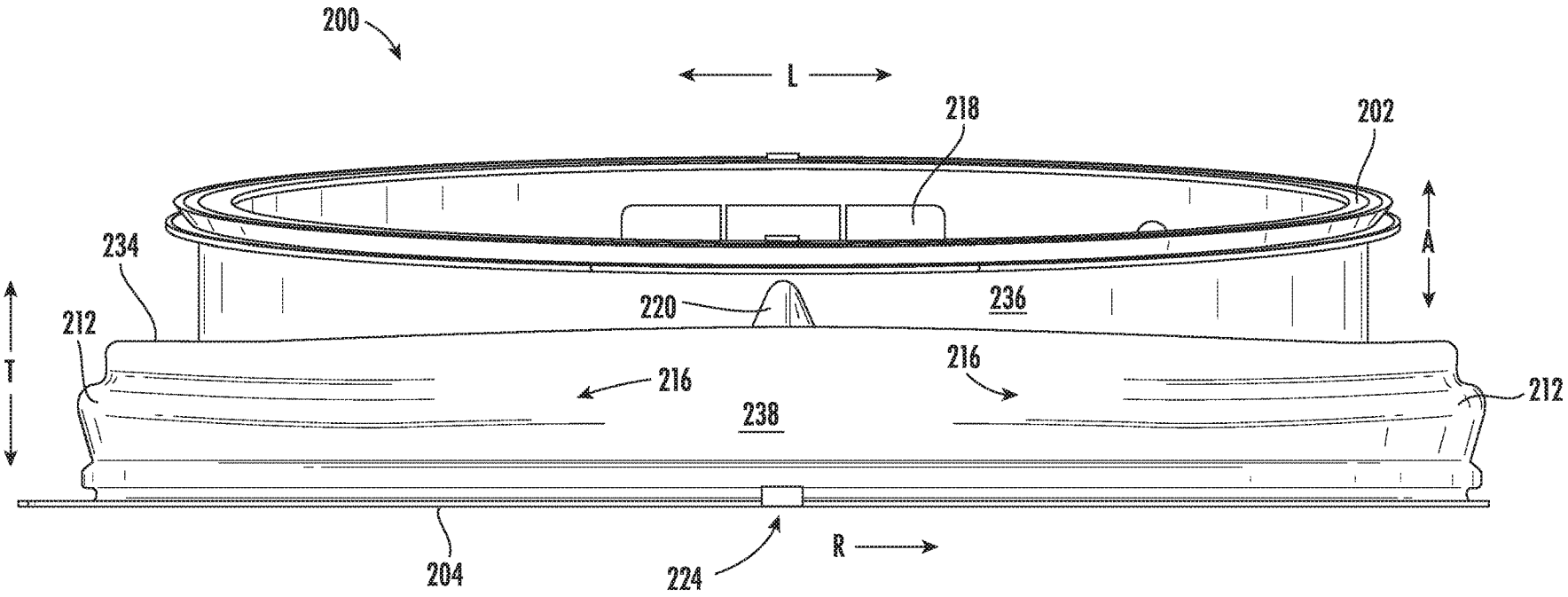
FIG. 7 provides a bottom view of the gasket of FIG. 3.

FIG. 6 provides a top view of the gasket 200 and FIG. 7 provides a bottom view of the gasket 200. The channel starts 214 of each of the first channel 212 and the second channel 212 are best seen in FIG. 6. The channel ends 216 of the first channel 212 and the second channel 212 are best seen in FIG. 7. As may be seen in FIGS. 6 and 7, the axial direction A of the gasket 200 is generally aligned with the transverse direction T of the washing machine appliance 100. As will be described in more detail below, the web 206 may include a front portion 236 and a trough 238. As may be seen in FIGS. 6 and 7, the channel 212 may be defined in the trough 238 of the web 206.

Figure 8:
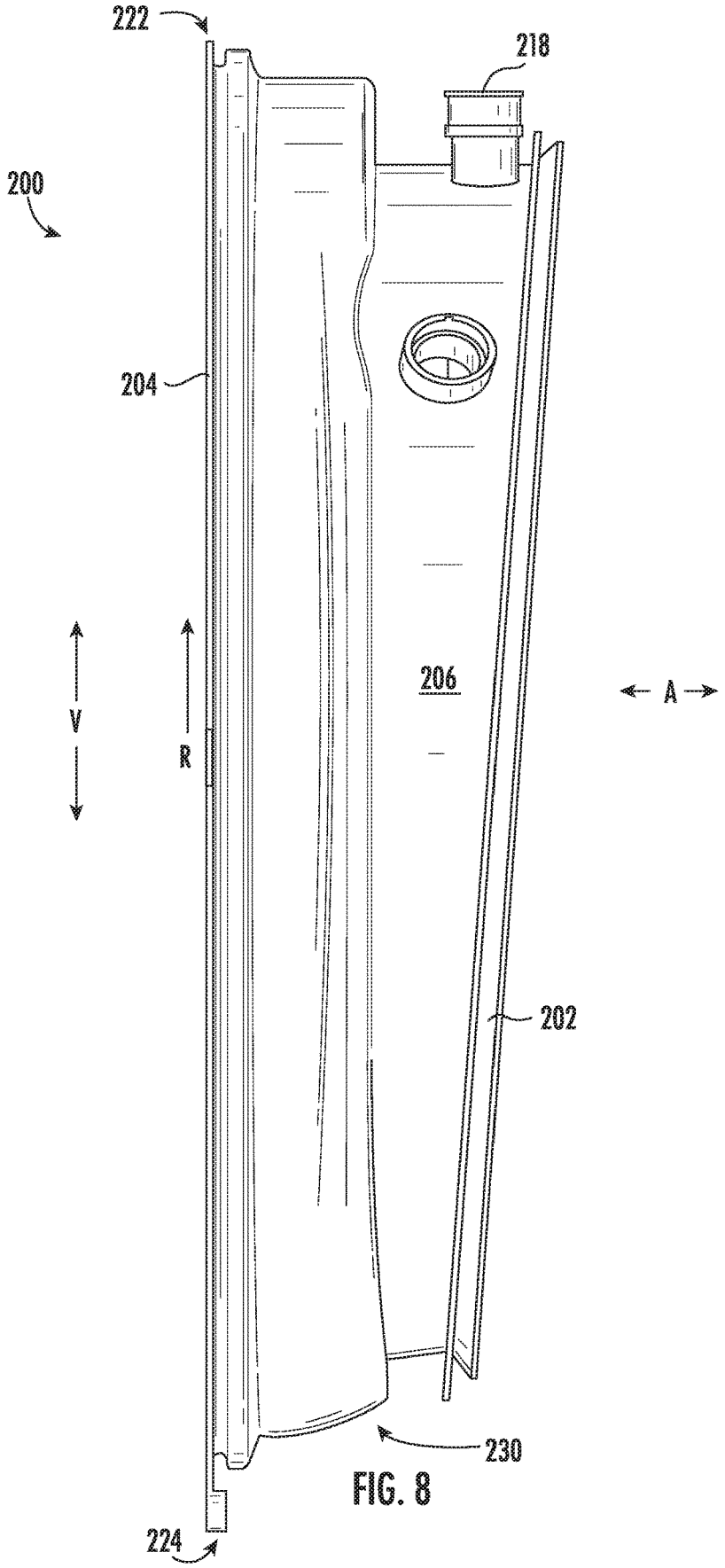
FIG. 8 provides a side view of the gasket of FIG. 3.
Figure 9:
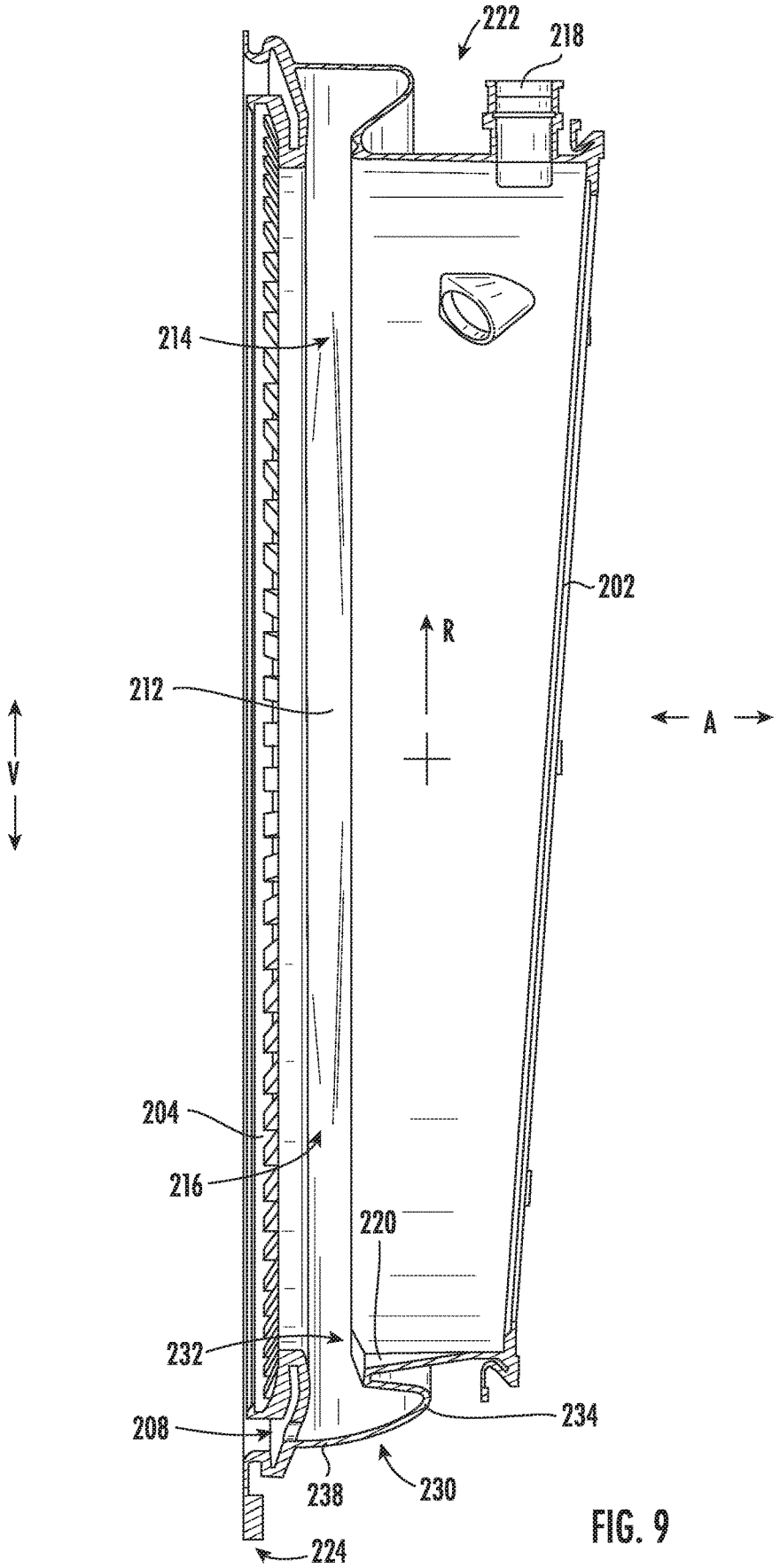
FIG. 9 provides a section view of the gasket of FIG. 3 taken along a vertical-transverse plane.

FIG. 8 provides a side view, e.g., a left side view looking generally from the left end 226 towards the right end 228, of the gasket 200. FIG. 9 provides a side section view corresponding to the side view of FIG. 8. The section view of FIG. 9 is taken along a vertical-transverse plane, e.g., a plane defined by the vertical direction V and the transverse direction T. In FIG. 9, the gasket 200 is bisected, e.g., sectioned through the top end 222 at the 12 o'clock position and the bottom end 224 at the 6 o'clock position. FIG. 9 reveals some of the internal structure of the gasket 200, particularly of the web 206. As may be seen in FIG. 9, the web 206 may include an S-fold 230 including a first bend 232 and a second bend 234 and a trough 238 extending from the second bend 234 to the back ring 204. The trough 238 may slope towards the drain holes 208.

Figure 10:
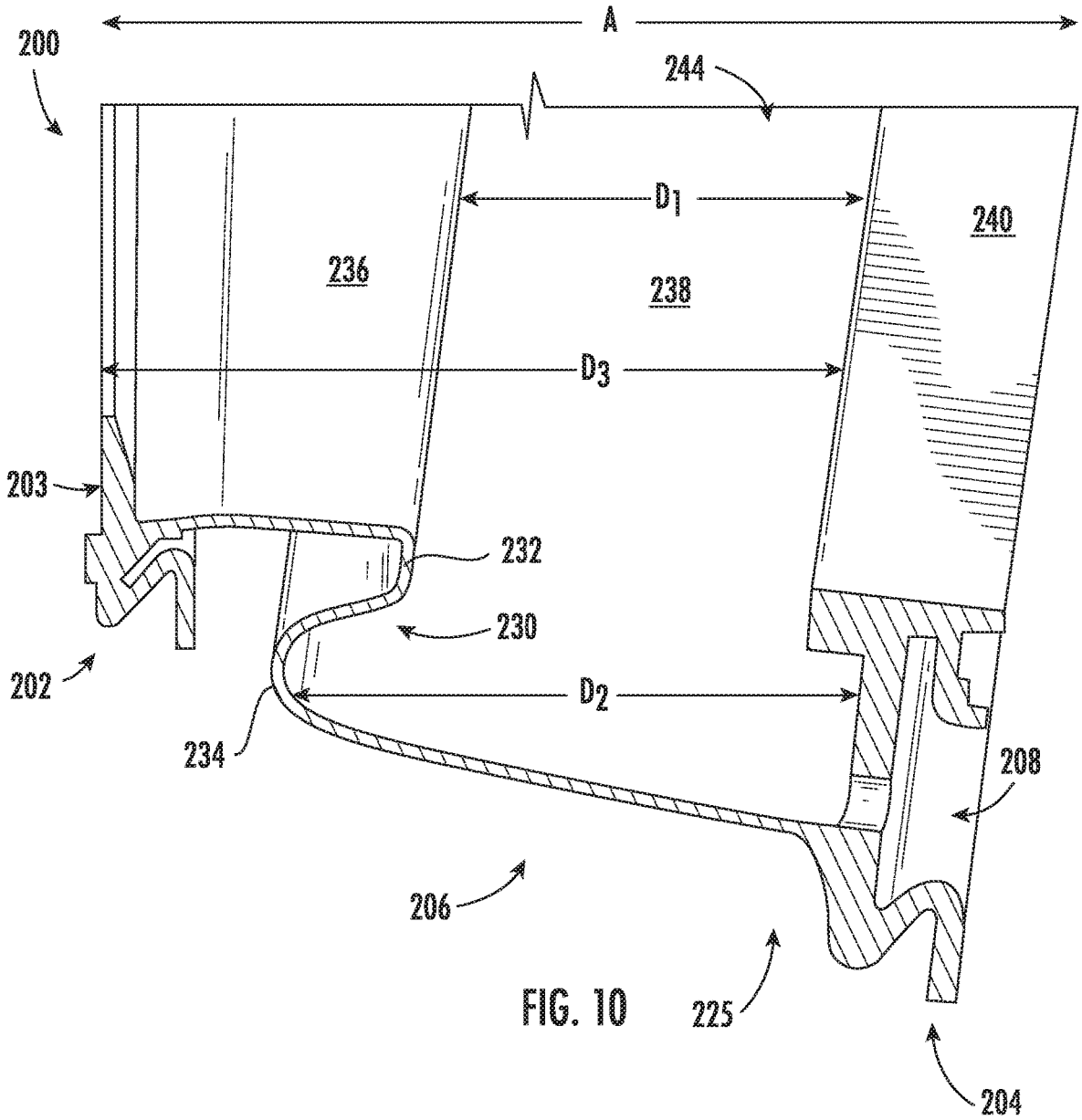
FIG. 10 provides an enlarged partially sectioned perspective view of a portion of an exemplary gasket for a washing machine appliance according to one or more embodiments of the present disclosure.

FIG. 10 provides an enlarged partially sectioned perspective view of a portion of the gasket 200 according to one or more example embodiments of the present disclosure. As may be seen in FIG. 10, the gasket web 206 may include a front portion 236 extending from the front ring 202 to the first bend 232 of the S-fold 230, and the trough 238 extending from the second bend 234 of the S-fold 230 to the back ring 204. Also shown in FIG. 10, a gap 244 may be defined between the first bend 232 and the back ring 204. The gap 244 may extend over a distance D1 along the axial direction A, e.g., the distance D1 may comprise a width of the gap 244. The distance D1 from the first bend 232 of the S-fold 230 to the back ring 204, e.g., an inner rim 240 of the back ring 204, along the axial direction A may be at least about forty percent (40%) of a distance D2 from the second bend 234 to the back ring 204 along the axial direction A, e.g., the distance D2 may comprise a width of the trough 238. For example, the distance D1 may be at least about fifty percent (50%) of D2, such as at least about sixty-seven percent (67%), such as at least about seventy-five percent (75%), such as about eighty-five percent (85%). The distance D1 from the first bend 232 of the S-fold 230 to the back ring 204, e.g., an inner rim 240 of the back ring 204, along the axial direction A may also be at least about twenty-five percent (25%) of a distance D3 from an outer face 203 of the front ring 202 to the back ring 204 along the axial direction A, e.g., the distance D3 may comprise a width of the front portion 236 of the web 206 plus the width of the gap 244. For example, the distance D1 may be at least about thirty-three percent (33%) of D3, such as at least about forty percent (40%), such as at least about fifty percent (50%), such as at least about sixty-seven percent (67%), such as at least about seventy-five percent (75%), such as about eighty-five percent (85%).

Figure 11:
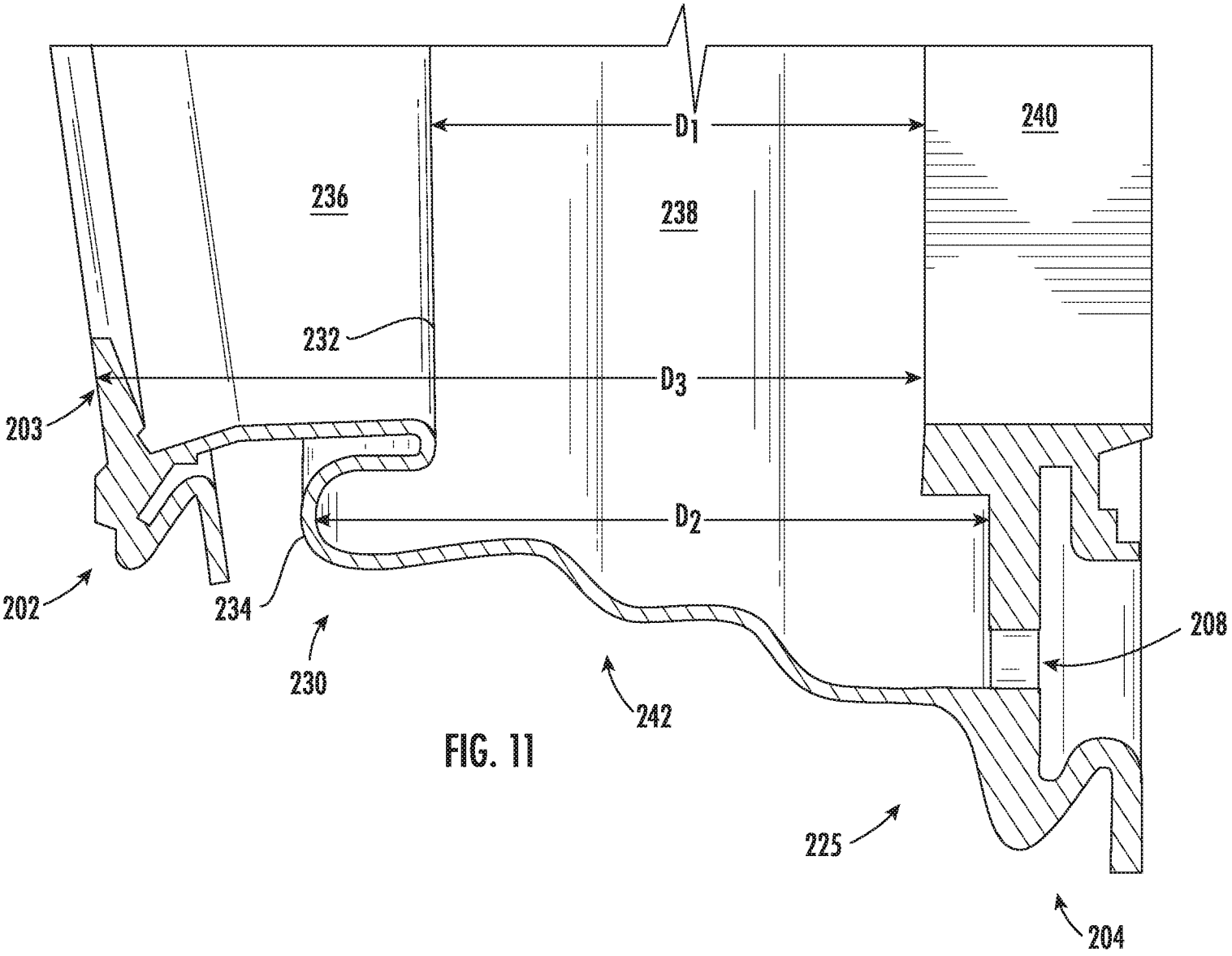
FIG. 11 provides an enlarged partially sectioned perspective view of a portion of an exemplary gasket for a washing machine appliance according to one or more additional embodiments of the present disclosure.

FIG. 11 provides an enlarged partially sectioned perspective view of a portion of an exemplary gasket for a washing machine appliance according to one or more additional embodiments of the present disclosure. In some embodiments, e.g., as illustrated in FIG. 11, the gasket 200 may include an undulation 242 in the trough 238 proximate the bottom end 224 of the gasket 200. In some embodiments, the undulation 242 may be contiguous with the channel 212, such that the undulation 242 may be considered a portion of the channel 212. Accordingly, in such embodiments, the channel 212 may be a single channel 212 which extends continuously along the circumferential direction C across the bottom end 224 of the gasket 200.

Figure 12:
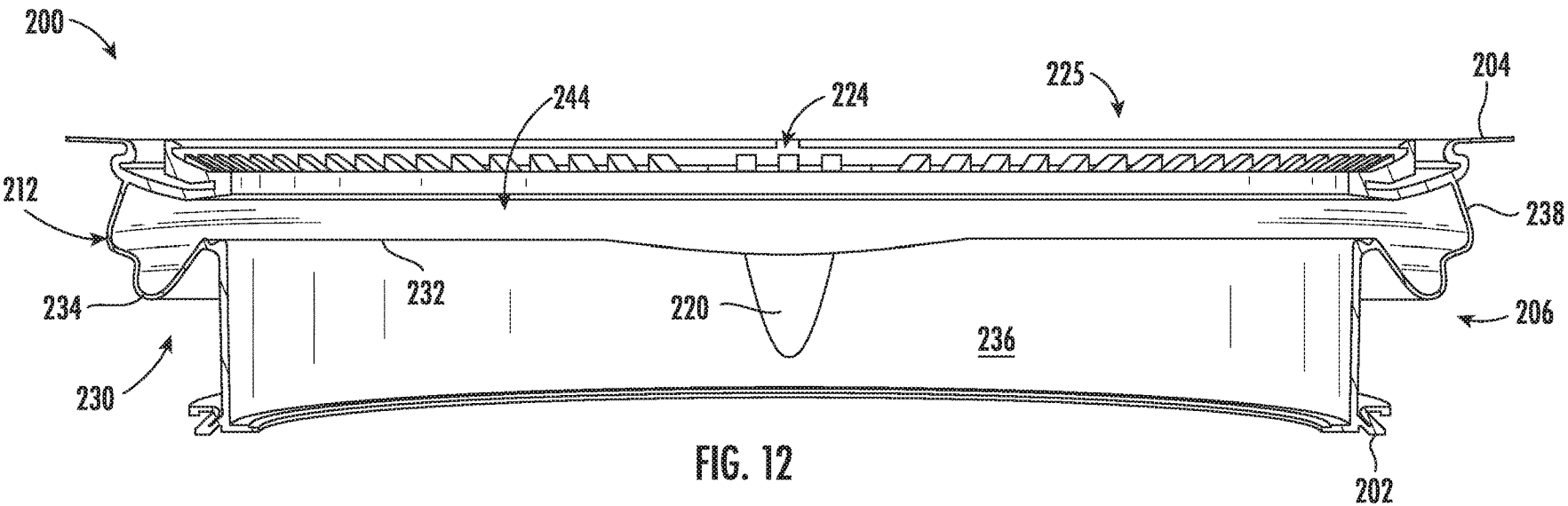
FIG. 12 provides a top-down section view of the gasket taken along line A-A in FIG. 5.
Figure 13:
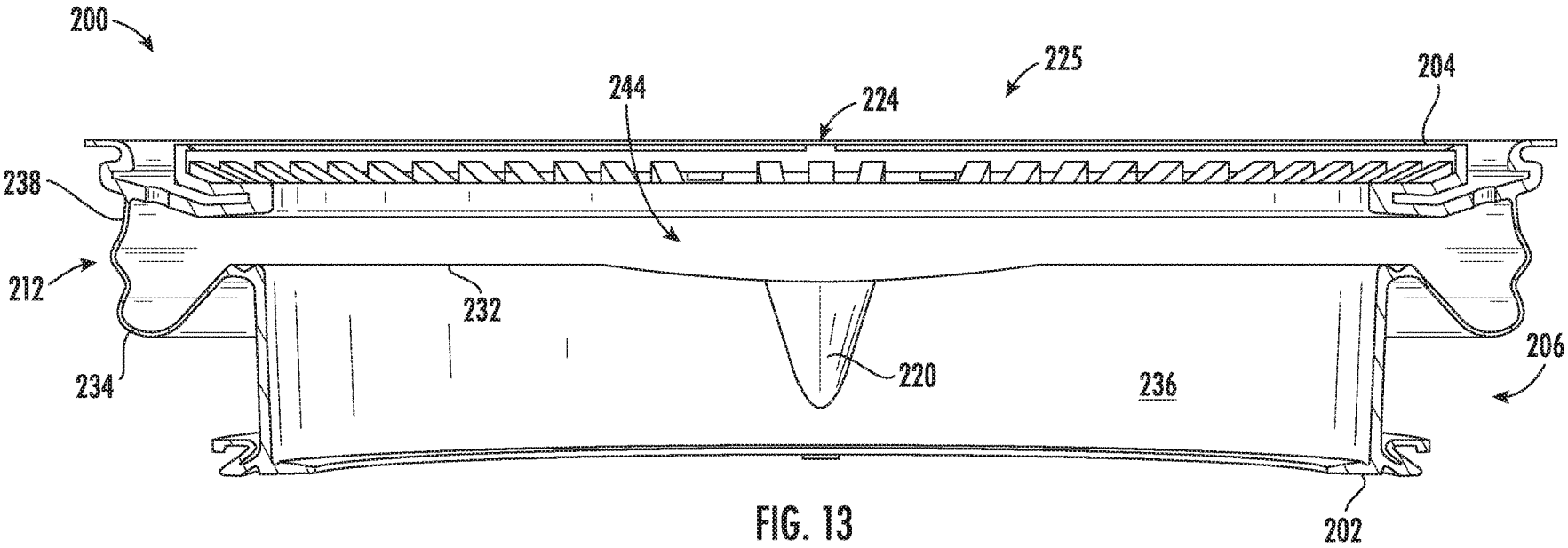
FIG. 13 provides a top-down section view of the gasket taken along line B-B in FIG. 5.
Figure 14:
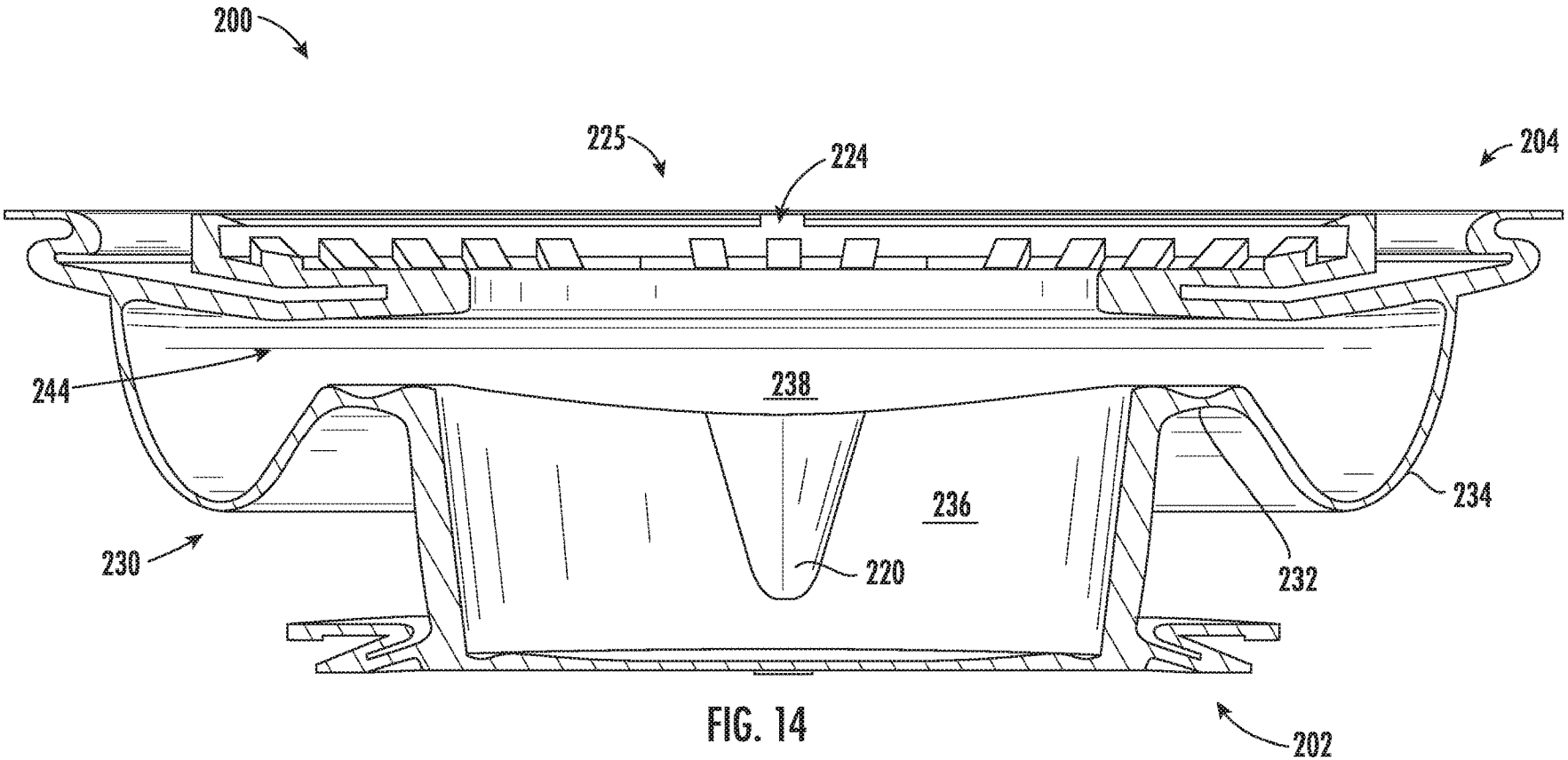
FIG. 14 provides a top-down section view of the gasket taken along line C-C in FIG. 5.

Turning now to FIGS. 12-13, a series of top-down section views are provided which illustrate, inter alia, variation of the profile of the channel 212 along the vertical direction V and/or the circumferential direction C. More specifically, FIG. 12 provides a top-down section view of the gasket 200 taken along line A-A in FIG. 5, FIG. 13 provides a top-down section view of the gasket 200 taken along line B-B in FIG. 5, and FIG. 14 provides a top-down section view of the gasket 200 taken along line C-C in FIG. 5. As may be seen in FIG. 12 and with reference to the location of line A-A in FIG. 5, the profile of the channel 212 is most pronounced at about the middle of the gasket 200. Turning now to FIG. 13, and again with reference to FIG. 5, it can be seen that the channel 212 in the trough 238 gradually becomes shallower as it moves down along the vertical direction V and/or towards the bottom end 224 of the gasket 200 along the circumferential direction C. As shown in FIG. 14, in some embodiments, e.g., where the undulation 242 (FIG. 11) is not provided, the channel 212 ends before reaching the bottom end 224 of the gasket 200, such that the trough 238 is generally smooth proximate the bottom end 224 of the gasket 200. It should be understood that the channel 212 is generally symmetrical about the lateral direction L. For example, the trough 238 is generally smooth at or around the top end 222 and the profile of the channel 212 is relatively shallow at the channel start 214 then increases to a maximum depth at about the middle (FIG. 12) of the gasket 200, e.g., at or around the left end 226 and/or the right end 228. Also, in embodiments where, as noted above, the channel 212 is centered on one of the left end 226 and the right end 228, the middle of the channel 212 may generally coincide with the middle of the gasket 200. In other embodiments, where the channel 212 continues across the bottom end 224 of the gasket 200 along the circumferential direction C, the middle of the channel 212 may be at or around the bottom end 224 of the gasket 200. In such embodiments, the profile of the channel 212 will generally be at a minimum at the middle of the channel 212, e.g., around the bottom 224 of the gasket 200, and will generally be at a maximum around each of the left end 226 and the right end 228, while the trough 238 will still be generally smooth proximate the top 222 of the gasket 200 in these embodiments as well. It should be understood that the minimum profile is greater than zero because the profile or depth of the channel 212 is greater than zero at any point within the channel 212, any point where the profile is zero would be considered outside of and not part of the channel 212.

Also as may be seen in FIGS. 12-14, the gasket 200 may include a divot 220 in the front portion 236 of the web 206. The divot 220 may be centered around the bottom end 224 of the gasket 200. The divot 220 may advantageously provide increased visibility into the trough 238. Additionally, the relatively large size of the gap 244, e.g., where the distance D1 is at least about forty or fifty percent of the distance D2 as described above with reference to FIGS. 10 and 11, may advantageously provide increased visibility into the trough 238. For example, during operation of the washing machine appliance 100, in particular over an extended period of time and multiple cycles of operation, articles and/or debris may become trapped within the gasket 200, in particular within the trough 238, and may obstruct the drain holes 208. For example, small articles of clothing, such as baby socks or skimpy underwear may be likely to become trapped in the trough 238. As another example, lint may get into the trough 238 and obstruct or clog the drain holes 208. In such instances, wash fluid may become trapped within the trough 238. Aspects and features of the gasket 200 according to the present disclosure may advantageously promote identification and removal of such obstructions from the drain holes 208, and may therefore aid in the prevention of stale or stagnant wash fluid collecting within the gasket 200, e.g., within the trough 238, and may reduce the instance of lost or misplaced laundry articles, e.g., socks, which may otherwise disappear into the gasket 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a wash tub positioned within the cabinet;

a wash basket rotatably mounted within the wash tub and accessible through an opening in the cabinet;

a door rotatably mounted to the cabinet whereby the door is rotatable between an open position permitting access to the wash basket through the opening and a closed position; and a gasket extending around the opening along a circumferential direction and extending between the cabinet and the wash tub along an axial direction, the gasket further defining a radial direction perpendicular to the circumferential direction and the axial direction, wherein the gasket sealingly engages the door when the door is in the closed position, the gasket comprising:

a front ring engaging the opening in the cabinet;

a back ring engaging the tub;

a web extending from the front ring to the back ring, the web comprising an S-fold, the S-fold defined by a first bend and a second bend, the second bend forward of the first bend along the axial direction and outward of the first bend along the radial direction, a front portion of the web extending along a straight line from the front ring to the first bend of the S-fold, a trough outward of the front portion along the radial direction, the trough extending from the second bend of the S-fold to the back ring, and a channel defined in the trough, the channel extending along the circumferential direction from a channel start to a channel end between a top portion of the gasket and a bottom portion of the gasket;

wherein a distance from the first bend of the S-fold to the back ring of the gasket along the axial direction is at least about twenty-five percent of a distance from the front ring to the back ring along the axial direction.

2. The washing machine appliance of claim 1, wherein the trough of the web comprises an undulation in the trough within a bottom portion of the gasket.

3. The washing machine appliance of claim 1, wherein the channel extends continuously across the bottom portion of the gasket along the circumferential direction.

4. The washing machine appliance of claim 1, wherein the channel extends along an arc of about ninety degrees.

5. The washing machine appliance of claim 4, wherein the channel is a first channel, further comprising a second channel opposite the first channel.

6. The washing machine appliance of claim 1, wherein the gasket further comprises a drain hole defined in the back ring.

7. The washing machine appliance of claim 6, wherein the trough slopes towards the drain hole.

8. The washing machine appliance of claim 1, wherein the gasket further comprises a divot in the front portion of the web.

9. A washing machine appliance comprising:

a cabinet;

a wash tub positioned within the cabinet;

a wash basket rotatably mounted within the wash tub and accessible through an opening in the cabinet;

a door rotatably mounted to the cabinet whereby the door is rotatable between an open position permitting access to the wash basket through the opening and a closed position; and a gasket extending around the opening along a circumferential direction and extending between the cabinet and the wash tub along an axial direction, wherein the gasket sealingly engages the door when the door is in the closed position, the gasket comprising:

a front ring engaging the opening in the cabinet;

a back ring engaging the tub;

a web extending from the front ring to the back ring, the web comprising an S-fold, a front portion of the web extending from the front ring to a first bend of the S-fold, a trough extending from a second bend of the S-fold to the back ring, and a channel defined in the trough, the channel extending along the circumferential direction from a channel start to a channel end between a top portion of the gasket and a bottom portion of the gasket.

10. The washing machine appliance of claim 9, wherein the channel extends continuously across the bottom portion of the gasket along the circumferential direction.

11. The washing machine appliance of claim 9, wherein the channel extends along an arc of about ninety degrees.

12. The washing machine appliance of claim 11, wherein the channel is a first channel, further comprising a second channel opposite the first channel.

13. The washing machine appliance of claim 9, wherein a distance from the first bend of the S-fold to the back ring of the gasket along the axial direction is at least about twenty-five percent of a distance from the front ring to the back ring along the axial direction.

14. The washing machine appliance of claim 9, wherein the trough of the web comprises an undulation in the trough within the bottom portion of the gasket.

15. The washing machine appliance of claim 9, wherein the gasket further comprises a drain hole defined in the back ring.

16. The washing machine appliance of claim 15, wherein the trough slopes towards the drain hole.

17. The washing machine appliance of claim 9, wherein the gasket further comprises a divot in the front portion of the web.

* * * * *